US008026856B2

(12) United States Patent
Yang et al.

(10) Patent No.: US 8,026,856 B2
(45) Date of Patent: Sep. 27, 2011

(54) ANTENNA AND WIRELESS COMMUNICATION DEVICE USING SAME

(75) Inventors: Chih-Yuan Yang, Taipei Hsien (TW); Po-Wei Kuo, Taipei Hsien (TW); Suo-Bing Su, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 331 days.

(21) Appl. No.: 12/489,411

(22) Filed: Jun. 22, 2009

(65) Prior Publication Data

US 2010/0026594 A1 Feb. 4, 2010

(30) Foreign Application Priority Data

Aug. 4, 2008 (CN) ..... 2008 1 0303370

(51) Int. Cl.
*H01Q 1/24* (2006.01)

(52) U.S. Cl. ..... 343/702; 343/767

(58) Field of Classification Search ..... 343/702, 343/700 MS, 767, 846
See application file for complete search history.

(56) References Cited

U.S. PATENT DOCUMENTS

| | | | | |
|---|---|---|---|---|
| 6,573,869 | B2 * | 6/2003 | Moore | 343/702 |
| 6,741,214 | B1 * | 5/2004 | Kadambi et al. | 343/700 MS |
| 2007/0085741 | A1 * | 4/2007 | Rafi et al. | 343/700 MS |
| 2007/0205947 | A1 * | 9/2007 | Boyle | 343/700 MS |
| 2009/0322638 | A1 * | 12/2009 | Chiang et al. | 343/770 |

* cited by examiner

*Primary Examiner* — Hoanganh Le
(74) *Attorney, Agent, or Firm* — Altis Law Group, Inc.

(57) ABSTRACT

An antenna includes a metallic sheet defining a first slot, a second slot, a third slot parallel to the first slot, a fourth slot parallel to the second slot, and a fifth slot parallel to the third slot. The second slot perpendicularly connects the first slot to the third slot and has a length smaller than that of the fourth slot. The third slot has a length greater than that of the first slot. The fourth slot extends perpendicularly from a side of the third slot away from the second slot. The fifth slot extends perpendicularly from an end of the fourth slot away from the third slot. The metallic sheet includes a first longitudinal side and a second longitudinal side opposite to the first longitudinal side. A feeding point is formed on the first longitudinal side and a grounding point is formed on the second longitudinal side.

13 Claims, 4 Drawing Sheets

ANTENNA AND WIRELESS COMMUNICATION DEVICE USING SAME

BACKGROUND

1. Technical Field

The present disclosure relates to an antenna and a wireless communication device using the same.

2. Description of Related Art

Wireless communication devices use specifically designed antennas to transmit and receive compatible radio-frequency signals. Cell phones, for example, are designed with antennas that are used to handle radio-frequency communications with cellular base stations. Handheld computers often include short-range antennas for handling wireless connections with wireless access points. Global positioning system (GPS) devices typically contain antennas that are designed to operate at GPS frequencies.

To ensure normal operation of the antenna, a housing or part of the housing of a wireless communication device may be made of plastic. However, plastic housings for wireless communication devices are usually less popular than metallic housings since metallic housings have a better appealing look and are more robust. However, a metallic housing often impacts the effectiveness of normal operation of the antenna contained therein.

DETAILED DESCRIPTION

Figure 1:
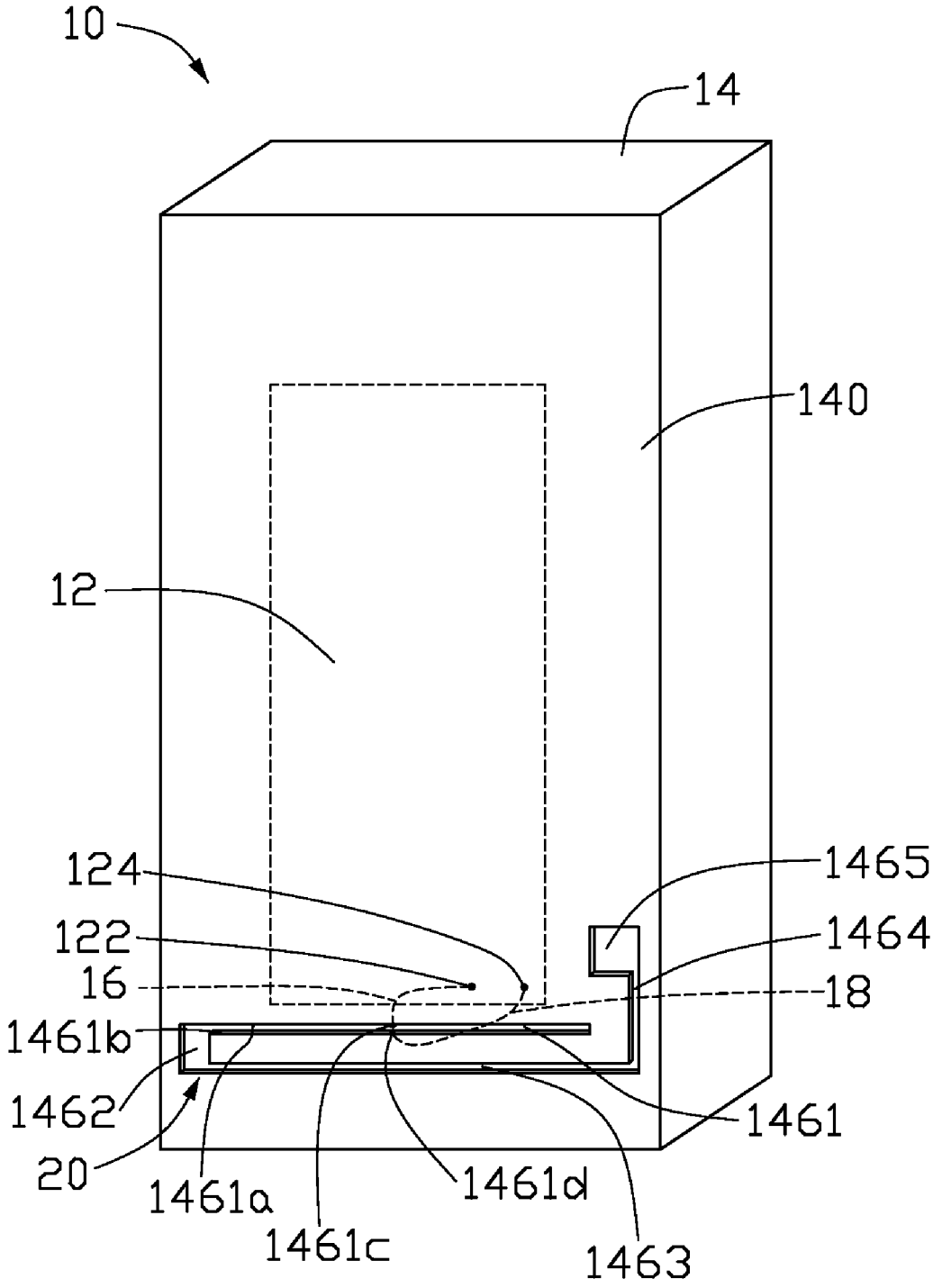
FIG. 1 is a schematic, isometric view of a wireless communication device including an antenna, according to an exemplary embodiment.
Figure 2:
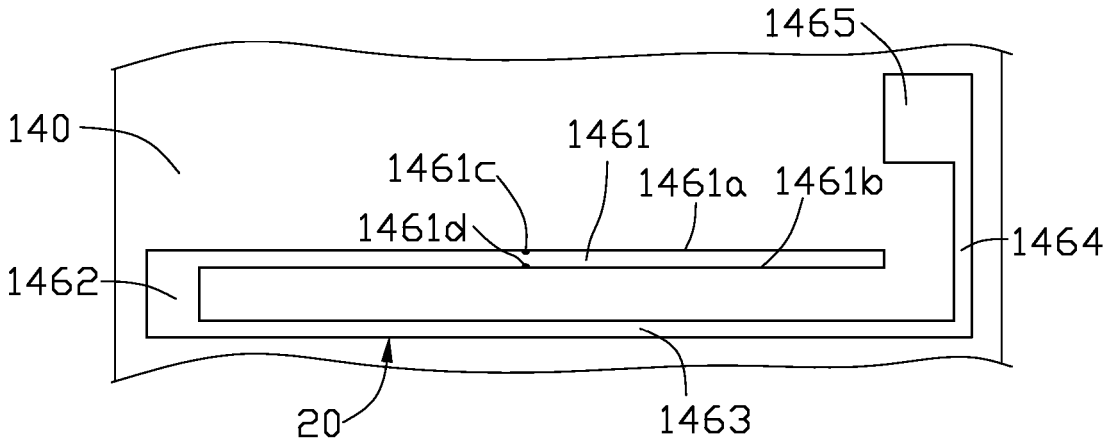
FIG. 2 is a schematic view of the antenna of the wireless communication device of FIG 1.

Referring to FIGS. 1 and 2, a wireless communication device 10 according to an exemplary embodiment includes a metallic housing 14, a circuit board 12 received in the metallic housing 14 and an antenna 20. In this exemplary embodiment, the wireless communication device 10 is a cellular phone. In other embodiment, the wireless communication device 10 may be a personal digital assistant device, a personal computer, or a laptop, etc.

The circuit board 12 includes a feeding portion 122 and a grounding portion 124.

The metallic housing 14 includes a rear sheet 140.

Referring to FIG. 2, the rear sheet 140 forms the antenna 20. The rear sheet 140 defines a first slot 1461, a second slot 1462, a third slot 1463 parallel to the first slot 1461, a fourth slot 1464 parallel to the second slot 1462, and a fifth slot 1465 parallel to the third slot 1463.

The second slot 1462 perpendicularly connects the first slot 1461 to the third slot 1463 via two adjacent ends thereof and has a length smaller than that of the fourth slot 1464. The fourth slot 1464 perpendicularly connects the third slot 1463 to the fifth slot 1465. The third slot 1463 has a length greater than that of the first slot 1461 and the fifth slot 1465. The fourth slot 1464 extends perpendicularly from an end of the third slot 1463 away from the second slot 1462. The fifth slot 1465 extends perpendicularly from an end of the fourth slot 1464 away from the third slot 1463. The extending direction of the second slot 1462 from the third slot 1463 is the same as that of the fourth slot 1464 from the third slot 1463. The extending direction of the first slot 1461 from the second slot 1462 is the same as that of the third slot 1463 from the second slot 1462. The extending direction of the fifth slot 1465 from the fourth slot 1464 is the same as that of the third slot 1463 from the fourth slot 1464. In this way, the first slot 1461 is adequately spaced from the fourth slot 1464 and from the fifth slot 1465. The slots 1461, 1462, 1463, 1464, and 1465 may be formed via punching or etching.

The rear sheet 140 includes a first longitudinal side 1461*a* and a second longitudinal side 1461*b* on another side of the rear sheet 140 opposite to the first longitudinal side 1461*a*. The first slot 1461 is partially bounded by the longitudinal sides 1461*a*, 1461*b*. A feeding point 1461*c* is formed on the first longitudinal side 1461*a*, and a grounding point 1461*d* is formed on the second longitudinal side 1461*b*. The feeding point 1461*c* is electrically connected to the feeding portion 122 using a wire 16, and the grounding point 1461*d* is electrically connected to the grounding portion 124 using a wire 18.

Figure 3:
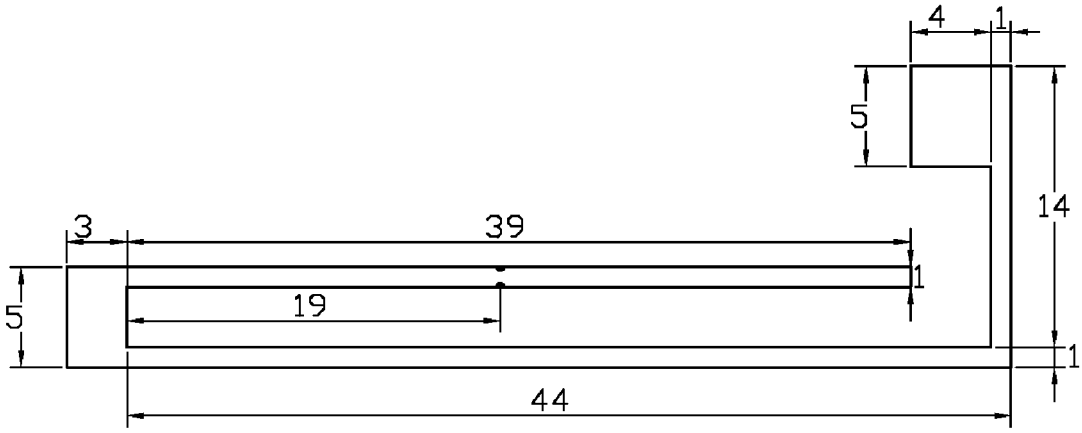
FIG. 3 is similar to FIG. 2, but showing the size of the antenna of FIG. 1.

Further referring to FIG. 3, the length of the first slot 1461 is approximately 39 millimeters (mm) and the width is approximately 1 mm. The length of the second slot 1462 is approximately 5 mm and the width is approximately 3 mm. The length of the third slot 1463 is approximately 44 mm and the width is approximately 1 mm. The length of the fourth slot 1464 is approximately 14 mm and the width is approximately 1 mm. The length of the fifth slot 1465 is approximately 5 mm and the width is approximately 4 mm. The distance from the feeding point 1461*c* to the second slot 1462 is equal to that from the grounding point 1461*d* to the second slot 1462, and is approximately 19 mm. The values described above have a permissible variable range at [−0.05, 0.05].

Figure 4:
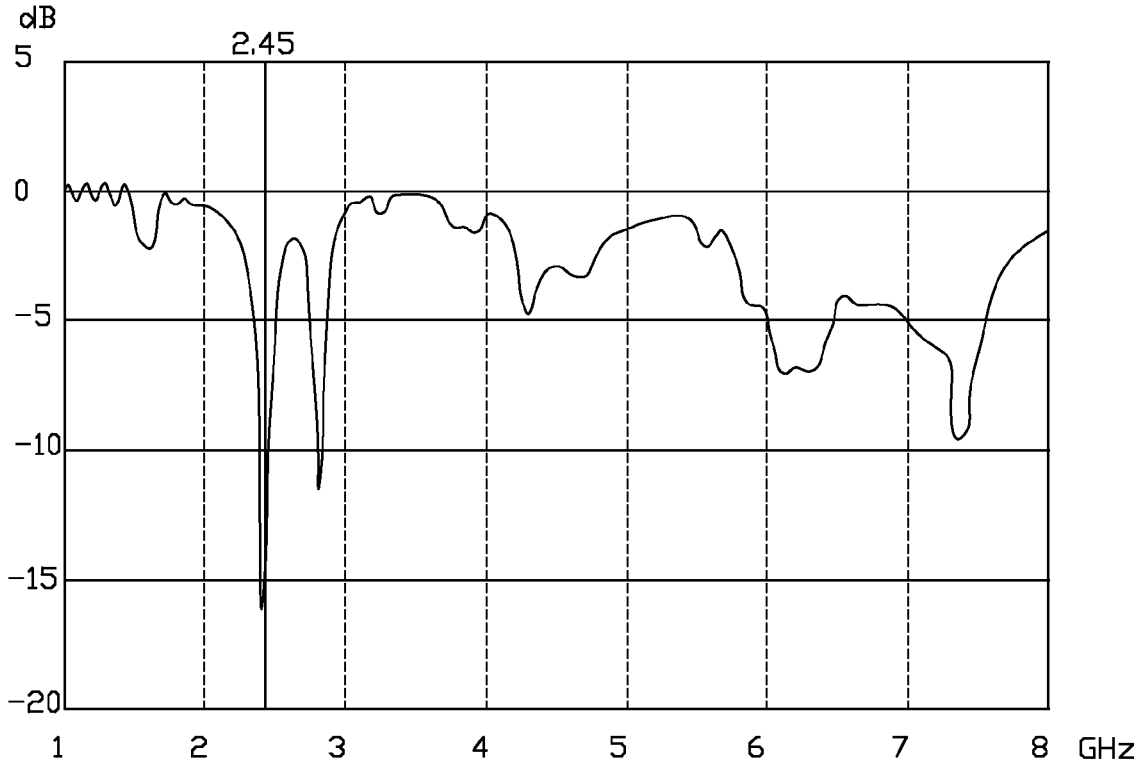
FIG. 4 is a graph showing the return loss versus frequency characteristic of the antenna of FIG. 2.

Further referring to FIG. 4, the return loss versus frequency characteristic of the antenna 20 is shown. The antenna 20 achieves a return loss about −16 dB at approximate 2.45 GHz for receiving or radiating wireless signals.

The wireless communication device is able to adopt a metallic housing while maintaining normal operation of the antenna.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An antenna comprising:

a metallic sheet defining a first slot, a second slot, a third slot parallel to the first slot, a fourth slot parallel to the second slot and a fifth slot parallel to the third slot, the second slot perpendicularly connecting the first slot to the third slot and having a length smaller than that of the fourth slot, the fourth slot perpendicularly connecting the third slot to the fifth slot, the third slot having a length greater than the length of the first slot, the fourth slot extending perpendicularly from an end of the third slot away from the second slot with the extending direction same as the extending direction of the second slot from the third slot, the fifth slot extending perpendicularly from an end of the fourth slot away from the third slot with the extending direction the same as the extending direction of the third slot from the fourth slot, the extending direction of the first slot from the second slot being the same as the extending direction of the third slot from the second slot, the metallic sheet comprising a first longitudinal side and a second longitudinal side opposite to the first longitudinal side, the first slot partially bounded by the first and second longitudinal sides;

a feeding point formed on the first longitudinal side; and a grounding point formed on the second longitudinal side.

2. The antenna as claimed in claim 1, wherein the slots are formed in the metallic sheet via punching.

3. The antenna as claimed in claim 1, wherein the slots are formed in the metallic sheet via etching.

4. The antenna as claimed in claim 1, wherein the length of the first slot is approximately 39 mm and the width is approximately 1 mm; the length of the second slot is approximately 5 mm and the width is approximately 3 mm; the length of the third slot is approximately 44 mm and the width is approximately 1 mm; the length of the fourth slot is approximately 14 mm and the width is approximately 1 mm; the length of the fifth slot is approximately 5 mm and the width is approximately 4 mm; and the distance from the feeding point to the second slot is equal to that from the grounding point to the second slot, and is approximately 19 mm.

5. A wireless communication device comprising:

a housing comprising a metallic sheet, the metallic sheet defining a first slot, a second slot, a third slot parallel to the first slot, a fourth slot parallel to the second slot and a fifth slot parallel to the third slot, the second slot perpendicularly connecting the first slot to the third slot and having a length smaller than that of the fourth slot, the fourth slot perpendicularly connecting the third slot to the fifth slot, the third slot having a length greater than the length of the first slot, the fourth slot extending perpendicularly from an end of the third slot away from the second slot with the extending direction the same as the extending direction of the second slot from the third slot, the fifth slot extending perpendicularly from an end of the fourth slot away from the third slot with the extending direction the same as the extending direction of the third slot from the fourth slot, the extending direction of the first slot from the second slot being the same as the extending direction of the third slot from the second slot, the metallic sheet comprising a first longitudinal side and a second longitudinal side opposite to the first longitudinal side, the first slot bounded by the first and second longitudinal sides;

a feeding point formed on the first longitudinal side; and a grounding point formed on the second longitudinal side.

6. The wireless communication device as claimed in claim 5, wherein the slots are formed on the metallic sheet via punching.

7. The wireless communication device as claimed in claim 5, wherein the slots are formed on the metallic sheet via etching.

8. The wireless communication device as claimed in claim 5, wherein the length of the first slot is approximately 39 mm and the width is approximately 1 mm; the length of the second slot is approximately 5 mm and the width is approximately 3 mm; the length of the third slot is approximately 44 mm and the width is approximately 1 mm; the length of the fourth slot is approximately 14 mm and the width is approximately 1 mm; the length of the fifth slot is approximately 5 mm and the width is approximately 4 mm; and the distance from the feeding point to the second slot is equal to that from the grounding point to the second slot, and is approximately 19 mm.

9. The wireless communication device as claimed in claim 5, wherein the wireless communication device is a cellular phone.

10. The wireless communication device as claimed in claim 5, wherein the wireless communication device is a personal digital assistant device.

11. The wireless communication device as claimed in claim 5, wherein the wireless communication device is a personal computer.

12. The wireless communication device as claimed in claim 5, wherein the wireless communication device is a laptop.

13. The wireless communication device as claimed in claim 5, further comprising a circuit board, the circuit board comprising a feeding portion and a grounding portion, the feeding portion electrically connected to the feeding point, the grounding portion electrically connected to the grounding point.

* * * * *